US005797288A

United States Patent [19]

Mas

[11] Patent Number: 5,797,288

[45] Date of Patent: Aug. 25, 1998

[54] APPARATUS FOR OPERATING A MULTIPLE-STAND MILL TRAIN

[75] Inventor: Luis Rey Mas, Berlin, Germany

[73] Assignee: Alcatel Alsthom Compagnie Generale d'Electricite, Paris, France

[21] Appl. No.: 754,424

[22] Filed: Nov. 22, 1996

[30] Foreign Application Priority Data

Nov. 25, 1995 [DE] Germany ..... 195 45 262.3

[51] Int. Cl.[6] ..... B21B 37/24

[52] U.S. Cl. ..... 72/7.1; 72/8.1; 364/578

[58] Field of Search ..... 72/7.1, 7.2, 8.1, 72/11.2; 364/149, 150, 151, 188, 191, 472.04–472.13, 578

[56] References Cited

U.S. PATENT DOCUMENTS

| | | | |
|---|---|---|---|
| 4,654,812 | 3/1987 | Yoshida | 72/11.2 |
| 5,353,217 | 10/1994 | Berghs et al. | 364/472.06 |
| 5,375,448 | 12/1994 | Katayana et al. | 72/8.3 |
| 5,502,992 | 4/1996 | Sorgel et al. | 72/9.2 |
| 5,537,605 | 7/1996 | Teece | 364/188 |
| 5,586,221 | 12/1996 | Isik et al. | 364/148 |

*Primary Examiner*—Joseph J. Hail, III
*Assistant Examiner*—Ed Tolan
*Attorney, Agent, or Firm*—Ware, Fressola, Van Der Sluys & Adolphson LLP

[57] ABSTRACT

An apparatus for operating a multiple-stand mill train is described which significantly reduces the expense and time for designing, testing and the start-up, including the optimization phase, and for restarting the roll operation of the mill train and which makes it possible to safely train the operators during operation and to extend the functionality of the mill train without creating damage. For this purpose, the entire mill train is simulated by a single physical simulation model (2) in a structured approach based on the technological interrelationship between the individual stands. The simulation model (2) is connected to a central control apparatus (1), wherein the apparatus alone provides the entire control of the mill train and optionally controls individual functions within each of the stands or of individual stands either via actuating members of the mill train or in corresponding units of the simulator model (2).

17 Claims, 3 Drawing Sheets

APPARATUS FOR OPERATING A MULTIPLE-STAND MILL TRAIN

TECHNICAL FIELD

The invention relates to an apparatus for-operating a multiple-stand mill train. The apparatus can be utilized in a cold rolling mill train as well as in other mill trains, such as a hot rolling mill train.

BACKGROUND OF THE INVENTION

The start-up and optimization phase of a multiple-stand mill train, but also its operation after a refurbishing, can introduce problems. On one hand, each of the stands represents actuating members having their own intelligence based on the mill technology, i.e., their own control means (with merely controlling set point allocation), as evidenced by the independent allocation of control hardware to each of the stands, thereby requiring considerable time and expense for each of the stands and their operators to achieve the necessary cooperation for an optimal rolling operation. On the other hand, the testing phase endangers the plant because not all operating parameters have been fixed yet.

It is therefore important to test control processes ahead of time on models.

For this purpose, only partial mechanical models have been developed until now. Mechanical models are very expensive and simply cannot be connected to a model plant encompassing the entire mill train. In addition, the replication of hardware models, for example for a mill train with 5 stands in tandem or 7 stands in tandem, is rather expensive. For this reason, at present all technical control means are implemented in a decentralized fashion (i.e., inside several different electronic cabinets) and are tested and put in service by several different people. Consequently, the work of the various people has to be closely coordinated.

In addition, in most cases the designers of the mechanical models and the users are not identical. They generally also belong to different companies. It is, however, very important that the control specialist has a mathematical and physical understanding of his own simulator (actuating member) in order to be able to optimally adjust his control means. At present, this can frequently not be guaranteed.

To the extent that software models (for describing each of the elements of a mill train in mathematical terms) have been applied until now, these software models were created in programming languages (e.g., assembler or the like) which the mill operator has difficulties understanding. Furthermore, these model programs are frequently executed on special computers and are consequently not compatible with the conventional application processors.

DISCLOSURE OF INVENTION

It is the object of the invention to provide an apparatus for operating a multiple-stand mill train which significantly reduces the expense and the time associated with each of the function tests and the start-up operation including the optimization phase and with re-starting the mill, for example, after the mill train has been refurbished, and which makes it possible to safely train the operators during the operation as well as to easily and safely extend the functionality of the mill train without damaging any elements.

According to the invention, an apparatus for operating a multiple-stand mill train, is characterized in that an entire mill train with respect to technological interrelationships between individual stands is simulated by a single physical simulation model having units interrelated according to said technological interrelationships in a structured fashion, and that the simulation model is for connection to a central control apparatus, wherein said central control apparatus alone provides technological control of the entire mill train and optionally controls individual functions within each of the stands or within individual stands either via actuating members of the mill train or in corresponding units of the simulation model.

With these features, a compact construction of otherwise expansive plant components is possible. The expenses can thereby be reduced by approximately 30 percent. The personnel costs for creating and implementing the software as well as the hardware cost are also reduced by about one half. As a result of employing the simple simulation model designed to physically simulate the technology-related interactions of the mill in conjunction with the central control apparatus, all functions, including all actuating members and a simulation of the dynamic behavior of the mechanical design, can be designed and optimized in a closed control loop with a limited number of personnel, i.e., generally with a single specialist. At the same time, the mill train can be designed in less time and started up earlier as a result of continuous simultaneous tests with the simulation model. This makes the training of personnel easier and more effective, both for the manufacturer and for the user. The functionality of the mill train can be safely upgraded at any time on the basis of a primary test with the simulation model. An optimized visualization for the plant operator (mill operator) can be provided by repeatedly simulating the rolling process during the test phase. Advance demonstrations of the mill train using a largely simulated operation are feasible at any time. Simultaneously, all technically relevant measured variables are administered centrally in the central control apparatus. With this, important measured values and status indicators can be measured and processed in real time. Processing (by a PC) is many times more cost effective and immediate than with the conventional systems used until now. When a refurbished mill train is restarted, the mill operators are trained on a simulation model, thereby preventing mechanical damage during the learning phase in spite of possible operating errors. Consequently, the learning phase for the operators is rather brief and effective. Mill drive motors, roll gap systems and the bending of the work rolls are implemented as actuating members without an inherent technical intelligence. As a result, the entire rolling technology is controlled and affected from one single point, namely the central control apparatus.

These and other objects, features and advantages of the present invention will become more apparent in light of the detailed description of a best mode embodiment thereof, as illustrated in the accompanying drawing.

BEST MODE FOR CARRYING OUT THE INVENTION

Figure 1:
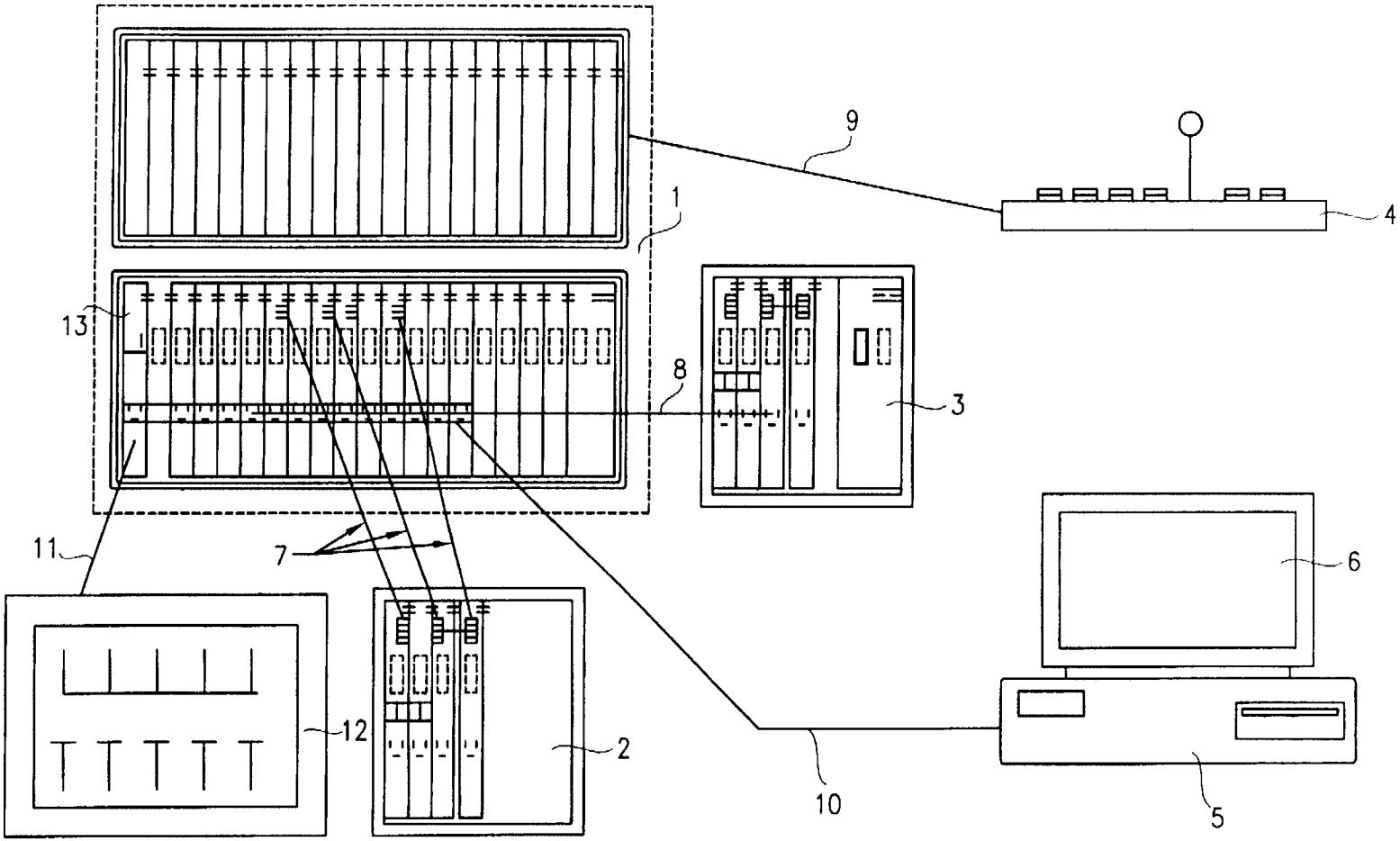
FIG. 1 is a grouping of devices for a simulation with the simulation model and the central mill technology-related control apparatus.

In FIG. 1, there is shown a central control apparatus 1 for a multiple-stand mill train (e.g., a mill train having 4 stands in tandem) illustrated in a form generally found in magazines specializing in electronic control technology. The following control means and functions are combined in the central control apparatus 1:

all thickness control functions for each of the stands with individual thickness pilot controls and monitor controls;

roll force-dependent tension set point adaptation for the rolling stock;

automatic set-up adaptation (set-up optimization);

automatic storing of set points in memory for programmed roll pass reduction and data acquisition as a function of the length of the rolling stock for a process computer;

setting the set point for work roll bending as a function of the roll force;

rolling stock tension control switchable on the fly via roll gap and roll speed;

tracking the rolling stock during the entering and exiting phase of the rolling stock;

entering and exiting technology with automatic control of the increase and decrease of tension on the rolling stock; automatic roll force relief;

semi-automatic load distribution in the stands with automatic adjustment of the corresponding thickness set points;

acquisition and processing of measured data for a graphic interpretation;

serial data exchange with thickness measuring instruments;

generation of additional values for the actuating members of a screw-down control, a speed control for the drive motors, and of a work roll bending.

In addition, all mill technology-related measured data and roll status indicators are processed in the central control apparatus 1 for acquisition and preliminary visualization using a graphic representation designed for mill technology-related requirements which is transmitted via a transmission line 11 from a card PC 13 to a display monitor 12.

It is also provided that the central control apparatus 1 can be used via another interconnection 8 for serial data exchange with a roll program computer 3 (for example, a memory for a programmed roll pass reduction or a mathematical roll model).

Furthermore, the central control apparatus 1 is communicating serially or in parallel with a simulation model 2 via link lines 7.

In addition, a connection 10 extends from the central control apparatus 1 to a PC 5 having a display 6 and a printer (not shown) for processing and recording, as the case may be, of process variables and signals.

Finally, the central control apparatus 1 is connected via a connection 9 to a central test control console 4.

The simulation model 2 includes as simulations several or all of the following units which are interconnected with each other based on the mill technology and in the order in which the stands are positioned in the mill train, and which transmit their actual values in real time to the central control apparatus 1:

converter-controlled drive motors with their speed control and their current regulator characteristics as well as with additional deformation and strip tension load, taking into account a mutual interaction of the loads via the rolling stock;

roll force models of the stands, as affected by roll gap, roll speed, pull-back and front tension and pre-deformation;

position control of the screw-down and of the roll gap control of the stands;

determination of the actual value of the tension of the rolling stock, taking into account material flow and roll speed;

simulation of the run time for the rolling stock and its impact on motor load, on the roll gap and on the actual values for the tension of the rolling stock;

master set point transmitter with a function "constant starting and end speed of the rolling stock";

bending of the work rolls;

manual corrections of the roll speed.

The corresponding number of the aforementioned units is determined by the respective elements in the mill train to be operated.

The executable simulator programs for each of the units of the simulation model provide the following measured values: strip tensions, roll forces, roll speeds, master set point, actual bending values, thickness deviations, motor currents (in the power converter feeding the motors) and valve currents of the hydraulic screw-down control.

In order for the models to be able to convey the aforedescribed signals to the simulation model 2, the models require, among others, the following values and signals: strip thickness before the first stand, roll gap position of each of the stands (setup value), additional values for the positions of the sides A and B of the rolls, additional values for the speeds in each of the stands, set values for the bending of the rolls of each of the stands, rolling stock tracking signals for the location of the rolling stock upon entering into and exiting from the roll gap, respectively, as well as a signal indicating that the master set point is greater than zero (LSW>0), meaning that the machine is operating. All these signals and data are exchanged between the simulation model 2 and the central control apparatus 1 via the link lines 7.

Figure 2:
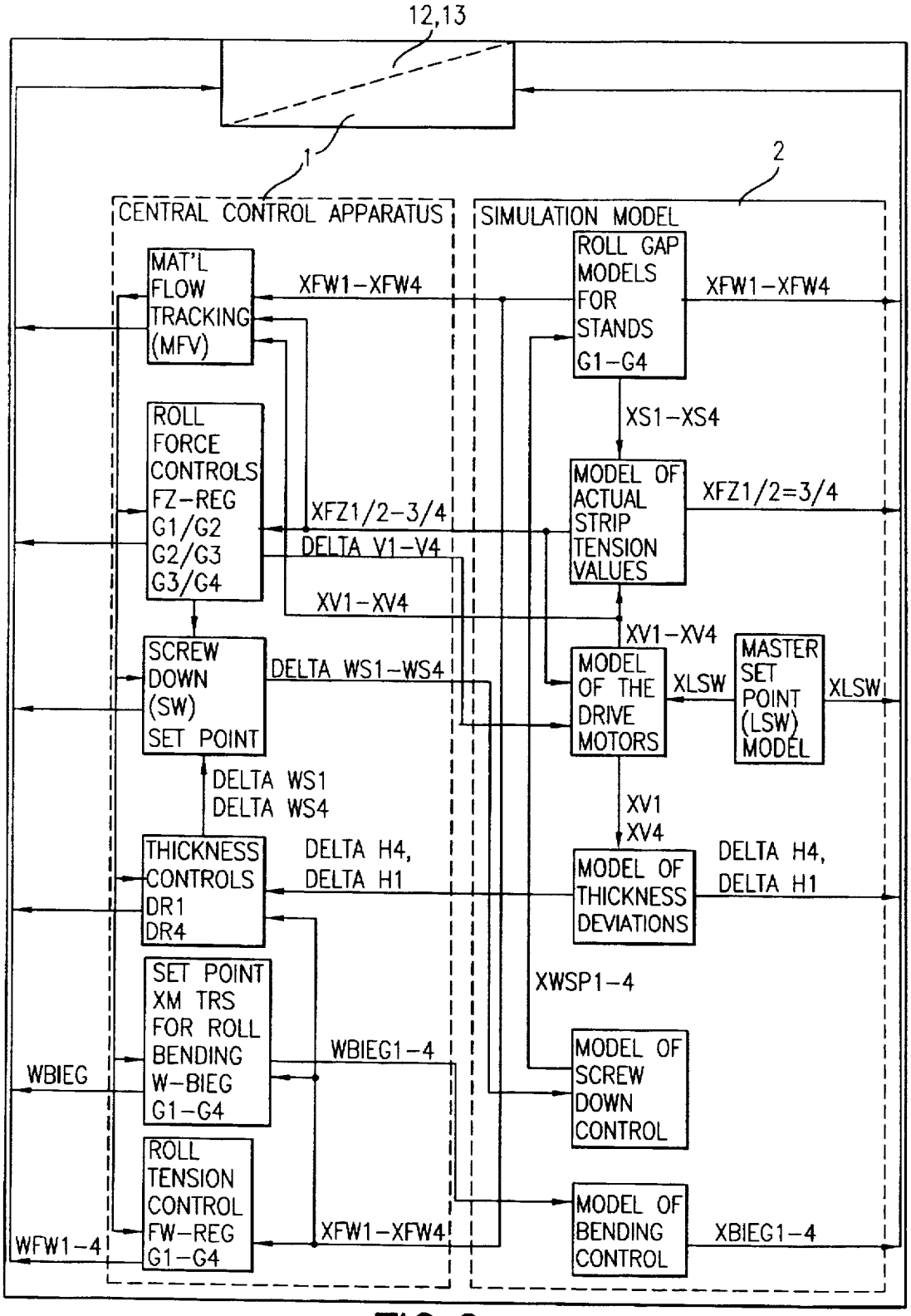
FIG. 2 is a block diagram for connecting the simulation model and the mill technology-related control means.

FIG. 2 shows a block diagram of the connection between a mill train simulated with the simulation model 2, as illustrated by a tandem mill train with four stands G1 to G4, and the central control apparatus 1 and the connections to the card PC 13 with the display monitor 12.

The simulation model 2 comprises roll gap models for the stands G1 to, in this case, G4. These models convey corresponding actual roll force values XFW1 to XFW4 to the central control apparatus 1, in particular to a material flow tracking MFV therein, to roll force controls FW-Reg for the stands G1 to G4, to set point transmitters W-Bieg for the roll bending in stands G1 to G4, and to the thickness controls DR1 and DR4 for the stands G1 and G4. For this purpose, the roll gap models receive corresponding actual values XWSP1 to XWSP4 from models for controlling the screw-down. In addition, the roll gap models for the stands G1 to G4 provide actual roll gap values XS1 to XS4 to models for the actual strip tension values XFZ1/2 and XFZ3/4 between the stands G1 and G2 and between the stands G3 and G4, respectively. These actual strip tension values XFZ1/2 and XFZ3/4 are supplied to the central control apparatus 1, in particular to the material flow tracking MFV and to the strip tension controls FZ-Reg for the strip tensions between the stands G1 and G2, G2 and G3, and G3 and G4.

The simulation model 2 further comprises models of the drive motors for the rolls in the stands G1 to G4. The drive motor models receive the controlling master set point value XLSW from a model LSW. In addition, they receive, from the strip tension controls FZ-Reg, control commands Delta V1 to Delta V4 for speed deviations of the drive motors and receive, from the models for the actual values of the strip tension between the stands G1 and G2 and G3 and G4, the actual values of the strip tension XFZ1/2 and XFZ3/4. The drive motor models convey corresponding actual values XV1 to XV4 for the drive motor speeds on stands G1 to G4 to the models for the actual strip tension values and the material flow tracking MFV with and also convey actual values XV1 to XV4 for the drive motor speeds on the stands G1 and G4 to a model for thickness deviations on the stand G1 and on the stand G4.

The model for thickness deviations on the stand G1 and on the stand G4 transmits the thickness deviations Delta H1 and Delta H4 derived from the actual drive motor speed values XV1 to XV4 to the thickness controls DR1 and DR4 in the central control apparatus 1.

In the central control apparatus 1, the thickness controls DR1 and DR4, with the signals Delta WS1 and Delta WS4 corresponding to the deviation of the roll gap on the stands G1 and G4, and the strip tension controls FZ-Reg affect a SW (set point) screw-down for the roll gaps of each of the stands G1 to G4, which conveys to the drive motor models additional roll gap set point values Delta WS1 to Delta WS4 corresponding to the deviations of the roll gaps on the stands G1 to G4.

In the central control apparatus 1, the material flow tracking MFV controls the strip tension controls FZ-Reg, the SW (set point) screw-down for the roll gaps, the thickness controls DR1 and DR4 for the stands G1 and G4, the roll tension control FW-Reg as well as the set point transmitter W-Bieg, all of which convey roll bending set values WBieg1 to WBieg4 for the stands G1 to G4 to models for controlling the bending in the simulation model 2. From these numbers, the bending control models calculate the actual roll bending values XBieg1 to XBieg4 on each of the stands G1 to G4.

The roll gap models, the actual strip tension models, the master set point model, the models for the thickness deviations on the stands G1 and G4 as well as the bending control models are transmitted, as shown in FIG. 2, to the card PC 13 for visual display on the display monitor 12. The same happens with the output values from each of the units of the central control apparatus 1, i.e., the material flow tracking MFV, the strip tension controls FZ-Reg, the set point transmitters W-Bieg for the roll bending and the roll force controls FW-Reg (which generate the roll force set points WFW1 to WFW4 for each of the stands G1 to G4).

In the physical simulation model where the main object is the trend of the generated signals and the dynamic interrelationship and not so much the exact metallurgical computation, individual units can be deactivated in order to simulate special situations. Instead of the deactivated units of the simulation model 2, corresponding actual values recorded on the mill train, i.e., actual measured quantities, can be used. With this, for example, the operators of a mill train can during a training phase experience a smooth transition from a simulated operation to the actual operation.

Figure 3:
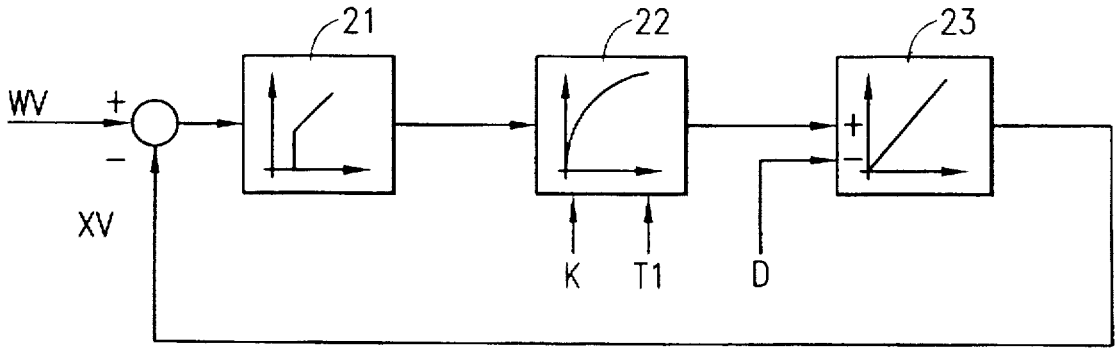
FIG. 3 is a block diagram of a basic model for controlling drives as implemented in the simulation model.

FIG. 3 shows the basic design of a model simulation of a converter-controlled drive motor with its drive control (speed control with cascaded armature current control) in the simulation model 2. The drive motor behaves in the same way as an integrator. For this reason, in FIG. 3 the simulated motor is represented as an integrator 23. The output variable of the integrator 23 is proportional to the drive motor speed or the speed of the rolling stock, as the case may be. The positive input variable to the integrator 23 corresponds to the armature current (electric work) supplied to the motor by the converter circuit. The negative input signal to the integrator 23 corresponds to the mechanical work which has to be performed by the drive motor in order to maintain its speed. If both input signals to the integrator 23 are of equal value, then this condition corresponds to the state "sum of all torques equal to zero" and the motor continues to run at a constant speed. If the two input signals to the integrator 23 have a different value, then a residual torque is present resulting in an acceleration or a deceleration of the drive motor. The run-up time of the integrator 23 corresponds to the run-up time of the drive motor.

The VZ1 unit 22 shown in FIG. 3 simulates the properties of a bridge rectifier with a current regulator controlling the armature current. Herein, K denotes the adjustable rectifier gain and T1 the delay time of the control system (for example, resulting from a built-in transformer, the motor inductance and the characteristics of the armature current controller of the drive motor).

A PI controller 21 which corresponds to the speed controller of an actual motor and receives the deviation between a preset speed value WV and the actual speed value XV from the output of the integrator 23, is in this case also the source for the roll and acceleration current. A separate signal representing an acceleration is not provided for, but may easily be added later. For this, the master set point transmitter model (see FIG. 2) has to supply an acceleration signal corresponding to the roll data. The proportional and integral parameters of the PI controller 21 correspond to the values of the speed controllers in the drive controls for the mill train.

A motor load model which supplies the value D connected to the negative input of the integrator 23, as shown in FIG. 3, takes into consideration that the drive motor is loaded by the deformation and tension torques generated by the rolling stock. The deformation torque is proportional to the deformed volume (input thickness minus output thickness times strip width) and to the resulting roll force. The drive motor is loaded by the pull-back tension of the rolling stock and relieved by the front tension of the rolling stock. The difference between these two tension values operates on the motor shaft as a rolling stock tension torque. The three quantities deformation, pull-back tension and front tension have to be added to the motor model with a slope limitation. The load models have to be connected to the negative input of the integrator 23 via a signal generated by the rolling stock tracking employed. The load itself has to include first the rolling stock deformation without the pull-back tension. This deformation is calculated from the difference in thickness between the entering and exiting rolling stock (rolling stock cross section). The entering rolling stock cross section of a stand equals the exiting cross section of the previous stand. The entering cross section must be part of a segment of the rolling stock. Rolling stock segment tracking must consequently store the rolling stock cross sections in memory and transport these cross sections in relation to the speed (rolling stock segment model). The increase in the roll force and the load, respectively, have a slope which can be simulated by a slope-limiting element. If it is desirable to additionally simulate the friction of the back-up rolls, then a differential element would have to capture the increase in the roll force and the output signal of this element would have to be added separately.

The rolling stock tension between two stands is the integral of the instantaneous difference in material flow created in a roll gap. In order for a rolling stock tension to develop between two stands, at least at one point in time, one stand will have to have requested a larger quantity of material than the previous stand was able to deliver. The value $$\frac{\int(Va - Ve)dt}{(He - Ha)}$$

wherein He=input thickness, Ha=output thickness, Ve=entering speed, Va=exiting speed of the rolling stock, is directly proportional to the rolling stock tension. Since initially the entering rolling stock has to be stretched anew, the generating rolling stock tension is relieved by the entering rolling stock. The entire operation resembles in first approximation a combination of an integrator with a "discharge process" which is independent of the speed of the rolling stock. A computational model (not shown) for the rolling stock simulation can be implemented as an adder which initially computes the instantaneous mass flow difference in the roll gap. The mass flow difference is subsequently processed by a VZ1 unit. The VZ1 unit includes the combination of an integral function and a proportional function, thereby corresponding exactly to the required simulation function. In addition, the rolling stock speed and the absolute deformation are used for determining the gain (discharge characteristics) and the thickness of the rolling stock is used for determining the rise time.

Figure 4:
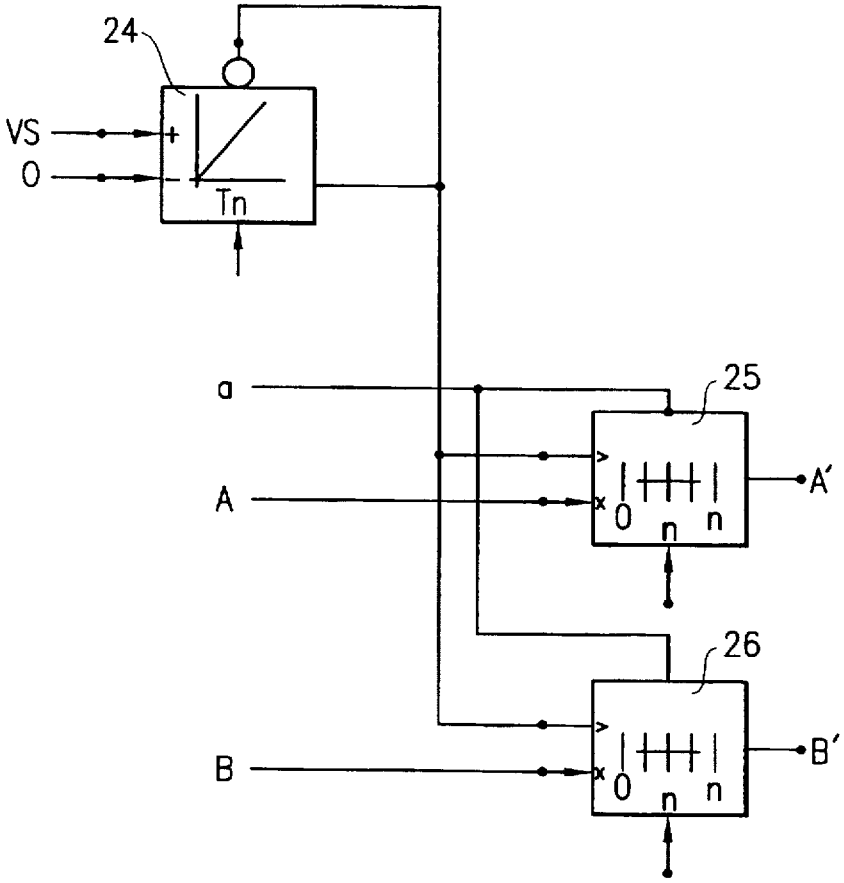
FIG. 4 is a block diagram for a strip flow model as implemented in the simulation model.

In order to be able to simulate the actual influence of the deformation in the roll gap and the associated effect in the next stand, the thickness of the rolled rolling stock sections are preferably entered into two shift registers 25, 26 of a rolling stock flow model shown in FIG. 4 (A: rolling stock thickness drive side; B: rolling stock thickness operator side). The accuracy of the mapping depends on the number of registers in the shift registers 25, 26. The clock frequency for the respective shift registers is derived from the rolling stock speed. For example, it is assumed that the screw-down of the stand G1 is moved, resulting in a corresponding thickness of the rolling stock in the roll gap of stand G1, with the thickness moving with a specific rolling stock speed VS in the direction of stand G2. The distance between the stands G1 and G2 is assumed to be m. The resulting transit time at a maximum rolling stock velocity VS is then $$t1=m:VSmax.$$

If the shift registers 25, 26 consist, for example, of 22 registers, then the rolling stock thickness stored in memory will have to have moved the distance m during the time t1 or will have to have been shifted by the clock through all 22 registers, as the case may be (A'=rolling stock thickness drive side after distance between the stands; B'=rolling stock thickness operator side after distance between the stands). This means that at a maximum velocity VSmax of the rolling stock the stored value must be shifted from one register to the next within the time t1:22. The corresponding clock frequency is accurately provided by an integrator 24 which is supplied with the corresponding velocity VS of the rolling stock and has an adjustable time constant Tn. The letter a in FIG. 4 denotes an initialization signal for the shift registers 25, 26.

A roll gap model (not shown here) represents the ratio of roll gap width to roll force. The roll force is the result of an absolute and a relative deformation of the rolling stock exerting a deformation resistance. This resistance decreases when the pull-back tension and the front tension increases and depends on the roll speed. The roll force increases during the initial pass of the nose of the rolling stock through the roll gap. The increase in the roll force is different for a roll gap control than for a standard screw-down control. The standard screw-down control forms the roll gap by adjusting the screw-down position and spring-biasing the stand. The roll gap control measures the distance of the work roll necks and keeps this distance constant. Consequently, the elastic modulus is compensated and does not have to be readjusted by the rolling stock tension control or the thickness control.

In a model for a screw-down control, the screw-down can be based on an electric motor driven screw-down control, a hydraulic screw-down control, or a direct roll gap control. Each one of the actuating members has different characteristics. For example, in an electric motor driven screw-down, the position during the first pass is maintained and the roll gap changes only as a result of the elastic modulus of the stand. A hydraulic control moves briefly apart during the first pass and subsequently controls again to the previous position, but remains spaced apart by the extent of the elastic elongation. A roll gap control moves apart during the first pass and controls theoretically to the same opening as for the first pass independent of the elastic modulus. These dependencies will have to be included in the models for the mill train to conform with the various actual conditions.

It will be understood that the operation of a multiple-stand mill train as described above is also applicable to a single stand mill train. Although the invention has been shown and described with respect to a best mode embodiment thereof, it should be understood by those skilled in the art that the foregoing and various other changes, omissions and additions in the form and detail thereof may be made therein without departing from the spirit and scope of the invention.

I claim:

1. Apparatus for operating a multiple-stand mill train, characterized in that an entire mill train with respect to technological interrelationships between individual stands is simulated by a single physical simulation model having units interrelated according to said technological interrelationships in a structured fashion, and that the simulation model is for connection to a central control apparatus, wherein said central control apparatus alone provides technological control of the entire mill train and optionally controls individual functions within each of the stands or within individual stands either via actuating members of the mill train or in corresponding units of the simulation model.

2. Apparatus according to claim 1, characterized in that the simulation model is provided with set point values of input thickness of rolling stock in the mill train, roll gap positions of the individual stands, values for speed of rolls of the individual stands, bending values of the rolls of the individual stands as well as rolling stock tracking signals when the rolling stock enters into and exits from a respective roll gap.

3. Apparatus according to claim 1, characterized in that the simulation model provides actual values for tension of rolling stock, roll forces, roll speeds, bending values of the rolls, thick deviations of the rolling stock and currents of drives of the individual stands.

4. Apparatus according to claim 1, characterized in that individual units of the simulation model are deactivatable.

5. Apparatus according to claim 1, characterized in that deactivated units in the simulation model are replaced by inserting corresponding actual measured values from the mill train.

6. Apparatus according to claim 1, characterized in that the simulation model comprises in the form of simulations at least two of the following units which are interconnected based on rolling mill technology and transmit actual values to the central control apparatus in real time:

converter-controlled drive motors with speed control and current regulator characteristics as well as with additional deformation and strip tension load, taking into account a mutual interaction of loads via rolling stock;

roll force models of the stands, as affected by roll gap, roll speed, pull-back and front tension and pre-deformation;

position control of screw-down control and of roll gap control of the stands;

determination of actual value of tension of rolling stock, taking into account material flow and roll speed;

simulation of run time for rolling stock and impact of the run time on motor load, roll gap and on actual values for tension of rolling stock;

master set point transmitter with a function indicative of constant starting and end speed of rolling stock;

bending of the work rolls; and manual corrections of the roll speed.

7. Apparatus according to claim 1, characterized in that in the simulation model each motor of the mill train is simulated by an integrating unit having two inputs, with one input accepting a positive voltage signal corresponding to electric torque and another input accepting a negative voltage signal corresponding to mechanical counter torque, and that an output of the integrating unit provides a signal corresponding to the speed of said each motor.

8. Apparatus according to claim 7, characterized in that a deformation torque proportional to a deformation volume of rolling stock and a tension torque of the rolling stock are included with a slope limitation, when the negative voltage signal corresponding to the mechanical counter torque is added.

9. Apparatus according to claim 8, characterized in that a variable corresponding to a roll gap control or a screw-down control of rolls is added when the deformation torque is formed.

10. Apparatus according to claim 8, characterized in that the deformation volume for the individual stands is provided in conjunction with a tracking of a rolling stock segment through the mill train.

11. Apparatus according to claim 10, characterized in that the tracking of a rolling stock segment is provided by a shift register having a clock frequency derived from speed of the rolling stock.

12. Apparatus according to claim 8, characterized in that a rolling stock tension simulation is provided by an adder unit for detecting an instantaneous mass flow difference in a roll gap, the adder unit followed by a first order delay unit.

13. Apparatus according to claim 7, characterized in that in the simulation model a controlling means effecting a rectifier and comprising a speed control with a cascaded armature current control for supplying individual motors of the mill train is simulated by a PI control unit with a succeeding first order delay unit, wherein the delay unit has a gain corresponding to a rectifier gain factor and a delay time corresponding to a delay time of a simulated control path.

14. Apparatus according to claim 1, characterized in that the central control apparatus comprises at least two of the following controls and functions:

thickness control functions for each of the stands with individual thickness pilot controls and monitor controls;

roll force-dependent tension set point adaptation for rolling stock;

automatic set-up adaptation for optimization;

automatic storing of used set points for a memory for programmed roll pass reduction and data acquisition as a function of rolling stock length for a process computer;

bending control and setting of set points for work roll bending with roll force adaptation;

rolling stock tension control switchable on the fly via roll gap and roll speed;

tracking rolling stock during an entering phase and an exiting phase;

entering and exiting technology with automatic control of an increase and a decrease of rolling stock tension and automatic roll force relief;

semiautomatic load distribution in the stands with automatic adjustment of corresponding thickness set points;

acquisition and visualization of measured values and roll status indicators related to mill technology, using a graphic representation designed for mill technology-related requirements;

acquisition and processing of measured data for a graphic interpretation;

serial data exchange with a roll program computer having a memory for a programmed roll pass reduction and mathematical roll model;

serial data exchange with thickness measuring devices;

serial or parallel communication with the simulation model; and generation of additional values for actuating members of a screw-down control, a speed control for drive motors, and of a work rolls bending.

15. Apparatus for simulating the operation of a multiple-stand mill train, characterized in that the multiple-stand train is simulated as a physical unit in a simulation model by electronic modules, and that the simulation model is connectable to a central control facility with which physical parameters of the multiple-stand mill train are measured, optimized, and controlled in real time, singly or in interdependences, both via final control elements of the multiple-stand mill train and optionally via the simulation model.

16. Apparatus for simulating the operation of a single-stand or multiple-stand mill train with a controller, for controlling an overall process including a plurality of sub-processes thereof, said apparatus comprising a simulation model which itself comprises plural model units, each model unit comprising a model of a corresponding one of said sub-processes, each model unit responsive to a corresponding setpoint signal from said controller or to a signal from another model unit, for providing an output signal to another model unit or for providing an output signal indicative of a simulated response of said corresponding one of said sub-processes for use by said controller in simulated control of said corresponding one of said sub-processes.

17. The apparatus of claim 16, wherein said simulation model is for use by said controller in simulated control of said overall process in whole or in part by use of one or more of said plural model units of said simulation model.

* * * * *

UNITED STATES PATENT AND TRADEMARK OFFICE

CERTIFICATE OF CORRECTION

PATENT NO. : 5,797,288

DATED : August 25, 1998

INVENTOR(S) : Luis Rey Mas

It is certified that error appears in the above-identified patent and that said Letters Patent is hereby corrected as shown below:

In column 10, line 47, after "controller", the comma should be deleted.

Signed and Sealed this

Fifth Day of January, 1999

*Attest:*

*Attesting Officer*

*Acting Commissioner of Patents and Trademarks*